US007299779B2

(12) United States Patent
Hegemier et al.

(10) Patent No.: US 7,299,779 B2
(45) Date of Patent: Nov. 27, 2007

(54) UPSIDE-DOWN SQUARE-UP VALVE STEM SEAL

(75) Inventors: Timothy A. Hegemier, Avilla, IN (US); Mark A. Stamback, deceased, late of Avilla, IN (US); by Cathy Stamback, legal representative, Avilla, IN (US)

(73) Assignee: Dana Corporation, Toledo, OH (US)

( * ) Notice: Subject to any disclaimer, the term of this patent is extended or adjusted under 35 U.S.C. 154(b) by 0 days.

(21) Appl. No.: 11/237,097

(22) Filed: Sep. 28, 2005

(65) Prior Publication Data

US 2006/0065227 A1 Mar. 30, 2006

Related U.S. Application Data

(60) Provisional application No. 60/614,200, filed on Sep. 29, 2004.

(51) Int. Cl.
*F02N 3/00* (2006.01)

(52) U.S. Cl. ..... 123/188.6; 123/190.7

(58) Field of Classification Search ..... 123/188.6, 123/190.7; 277/502

See application file for complete search history.

(56) References Cited

U.S. PATENT DOCUMENTS

| | | | | |
|---|---|---|---|---|
| 4,695,061 | A * | 9/1987 | Meisner et al. | 123/188.6 |
| 4,773,363 | A | 9/1988 | Stritzke | |
| 4,834,037 | A * | 5/1989 | Lafever | 123/188.6 |
| 4,909,202 | A | 3/1990 | Binford et al. | |
| 6,119,645 | A | 9/2000 | Hesher | |
| 6,209,504 | B1 * | 4/2001 | Hegemier et al. | 123/188.6 |
| 6,230,679 | B1 | 5/2001 | Hegernier et al. | |
| 6,244,235 | B1 * | 6/2001 | Hegemier et al. | 123/188.6 |
| 6,269,787 | B1 | 8/2001 | McArthy | |
| 6,450,143 | B1 | 9/2002 | Hegemier et al. | |

FOREIGN PATENT DOCUMENTS

EP 0136057 * 4/1985

* cited by examiner

*Primary Examiner*—Noah P. Kamen
(74) *Attorney, Agent, or Firm*—Marshall & Melhorn LLC

(57) ABSTRACT

A valve stem seal of an internal combustion engine is described wherein the valve stem seal includes an outer peripheral surface and an inner sealing surface. The inner sealing surface minimizes ingress of a liquid upwardly from an intake port area into an overhead engine area by having at least one sealing lip disposed on an upper portion of the inner sealing surface and extending away from the inner sealing surface. The sealing lip includes a generally square lower corner.

16 Claims, 2 Drawing Sheets

UPSIDE-DOWN SQUARE-UP VALVE STEM SEAL

CROSS-REFERENCE To RELATED APPLICATIONS

This application claims the benefit of U.S. Provisional Application Ser. No. 60/614,200 filed Sep. 29, 2004, which is hereby incorporated by reference in its entirety.

TECHNICAL FIELD

The embodiments of the invention described herein are generally directed to internal combustion engine valve stem seals.

BACKGROUND

In conventional overhead valve internal combustion engines, at least two valves reciprocate to provide intermittent communication between intake and exhaust manifolds and a combustion chamber. The valves include valve stems that are commonly disposed in valve stem guides, supporting axial motion in an engine component such as an engine head. Lubrication is provided to upper portions of the valve stems by a spray of lubricating oil within a valve cover disposed over the engine head or by gravity flow from an associated rocker arm. Oil flows by the force of gravity and may be encouraged by a pressure differential in the manifold versus crankcase pressure along a free upper end of the valve stem toward the manifolds and valve heads.

Valve guide seals located between the valve stem and the valve guide serve various purposes. First, they minimize engine oil consumption by restricting oil entry into the manifold and the combustion chamber. Second, they help to minimize exhaust particulates that contribute to pollution. Third, they are helpful in minimizing guide wear, which is of particular importance with diesel engines due to the nature of their operation.

The valve stem, valve guide, and valve guide seals are annularly wrapped by a helical compression valve spring that serves to bias the valve into a closed position. The longitudinal ends of the valve spring are restrained by flanges on corresponding valve stem seal retainers, valve spring retainers and/or spring seats, thereby maintaining proper alignment and position of the valve and valve spring. Typically, a flange on the valve stem seal retainer captures the lower end of the valve spring, but is not affixed to any other engine part. During engine operation, the valves are opened by transmitting drive forces from cams that are rotating in synchronism with the engine rotation to the stem ends of the valves via rocker arms.

Current valve stem seals are primarily concerned with preventing or controlling oil flow in a "downward" direction. In other words, current valve stem seal designs are directed to preventing oil flow from the overhead area of an engine to the port area of an engine. There exists a need for a valve stem seal that minimizes liquid flow in an upward direction, i.e., from the port area to the overhead area.

SUMMARY

In the embodiments and methods described, a valve stem seal of an internal combustion engine is employed wherein the valve stem seal includes an outer peripheral surface and an inner sealing surface. The inner sealing surface minimizes ingress of a liquid upwardly from an intake port area into an overhead engine area by having at least one sealing lip disposed on an upper portion of the inner sealing surface and extending away from the inner sealing surface. The sealing lip includes a generally square lower corner.

BRIEF DESCRIPTION OF THE DRAWINGS

The features and inventive aspects of the present invention will become more apparent upon reading the following detailed description, claims, and drawings, of which the following is a brief description:

DETAILED DESCRIPTION

Figure 1:
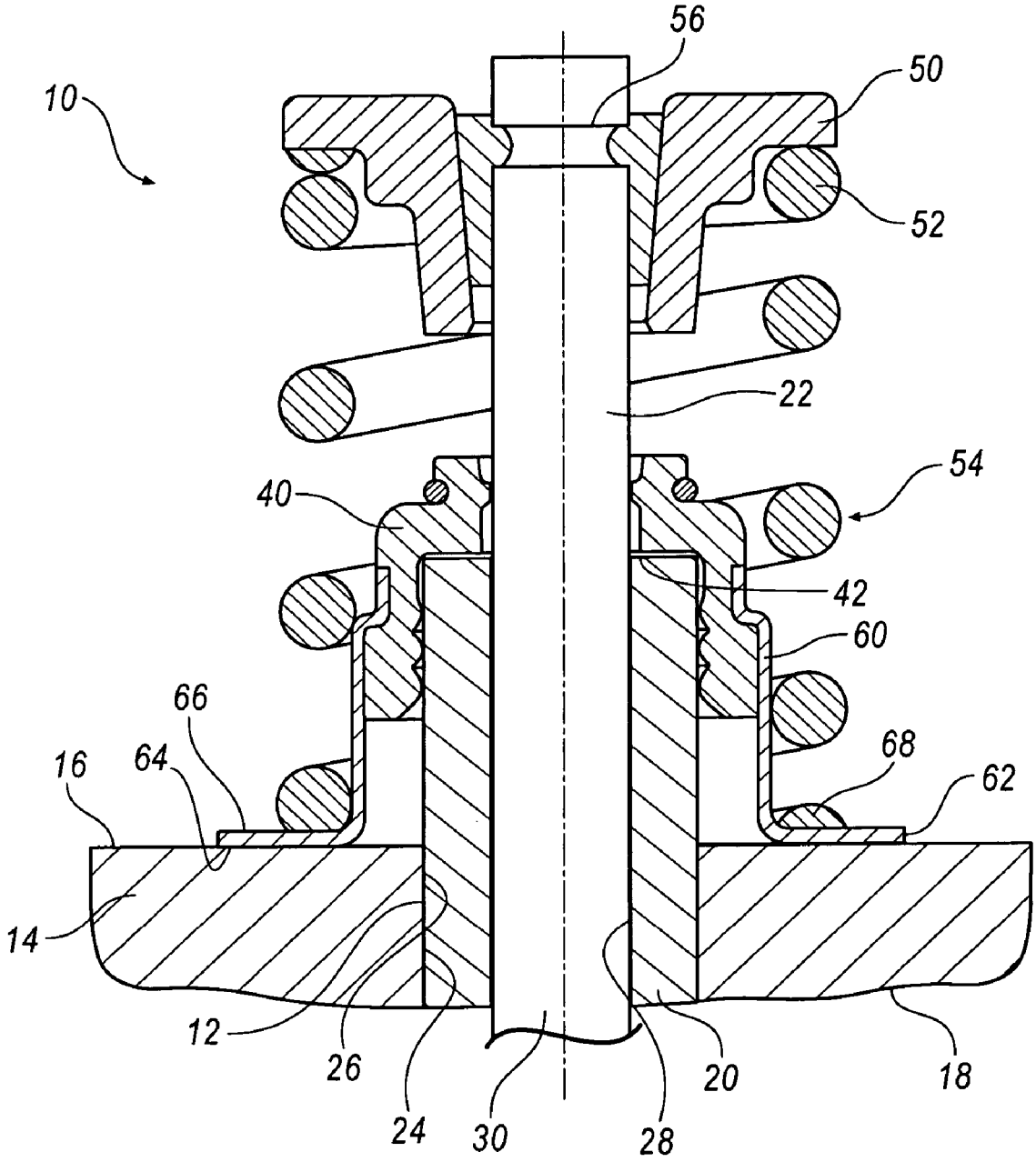
FIG. 1 is a cross-sectional view of a valve assembly including an embodiment of a valve stem seal assembly.

Referring now to the drawings, illustrative embodiments are shown in detail. Although the drawings represent the embodiments, the drawings are not necessarily to scale and certain features may be exaggerated to better illustrate and explain an innovative aspect of an embodiment. Further, the embodiments described herein are not intended to be exhaustive or otherwise limit or restrict the invention to the precise form and configuration shown in the drawings and disclosed in the following detailed description.

Referring now to FIG. 1, an internal combustion engine valve stem assembly 10 is adapted to be received in an axially extending bore 12 of an internal combustion engine component such as an engine head 14. Engine head 14 includes an upper axial surface 16 and a lower axial surface 18.

Valve stem assembly 10 includes an annular valve stem guide 20 surrounding a valve stem 22. Valve stem guide 20 may comprise two distinct annular guide sections (not shown), and may be formed from powdered metal. The radially outer surface 24 of the valve stem guide 20 closely corresponds to the diameter of bore 12 such that a very tight fit results between the valve stem guide 20 and the bore wall 26 when the valve stem guide 20 is inserted. Likewise, the diameter of the radial inner surface 28 of the valve stem guide 20 closely corresponds to the diameter of the radially outer surface 30 of the valve stem 22, resulting in a tight fit between the valve stem 22 and the valve stem guide 20, though no so tight as to prevent the valve stem 22 from reciprocating within the valve stem guide 20. A sealing member 40 disposed about the upper end 42 of the valve stem guide 20 extends longitudinally over a portion of both the radial outer surface 30 of the valve stem 22, and over a portion of the radial outer surface 24 of the valve stem guide 20.

In addition, an upper spring retainer 50 of conventional design restrains an upper portion 52 of a helical spring 54. Upper spring retainer 50 is removably attached to an upper portion 56 of the valve stem 22 such that the spring retainer 50 reciprocates with the valve stem 22, thereby compressing the spring 54.

Sealing member 40 is held in place by an annular valve stem seal retainer 60, typically of metal construction. In addition, the seal retainer 60 is formed with an annular flange 62 having a bottom surface 64 that rests in facing relationship with the upper surface 16 of the engine head 14. The upper surface 66 of the flange 62 acts a seat for a lower portion 68 of helical spring 54. It should be noted that the seal retainer 60 may comprise both a seal retainer portion and a separate support in the form of a separate hardened washer (not shown). In such an arrangement, the hardened washer includes a flanged portion interposed between lower portion 68 of spring 54 and the upper surface 16 of the engine head 14, thereby providing a seat for the helical spring 54.

As noted above, the sealing member 40 serves several purposes. First, sealing member 40 limits oil entry into the manifold and the combustion chamber. Second, sealing member 40 acts to minimize exhaust particulates that contribute to pollution. Third, sealing member 40 is helpful in minimizing wear of valve stem guide 20. Fourth, sealing member 40 minimizes liquid flow in the upward direction. That is, it minimizes liquid from traveling upwardly from the intake ports of the engine into overhead engine oil. The sealing member 40 may be made from rubber, plastic, polyamide resin, or any elastomeric material.

Figure 2:
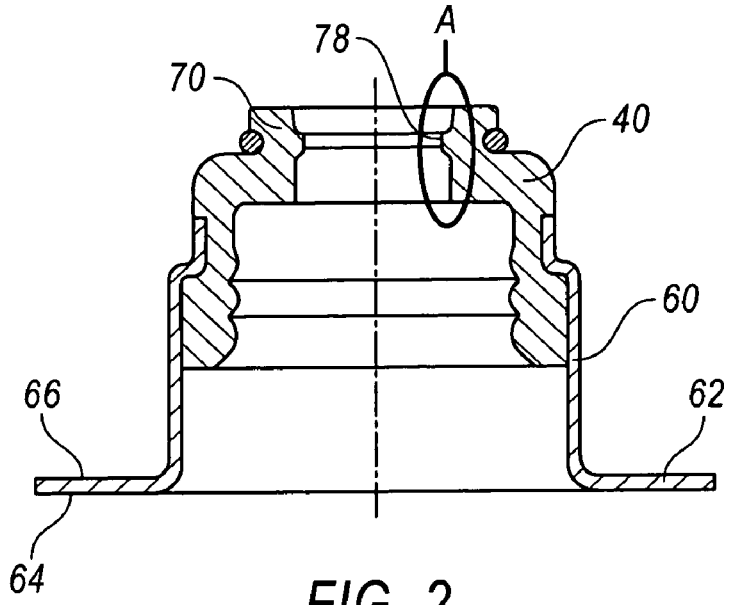
FIG. 2 is a cross-sectional view of the valve stem seal assembly of FIG. 1.
Figure 3:
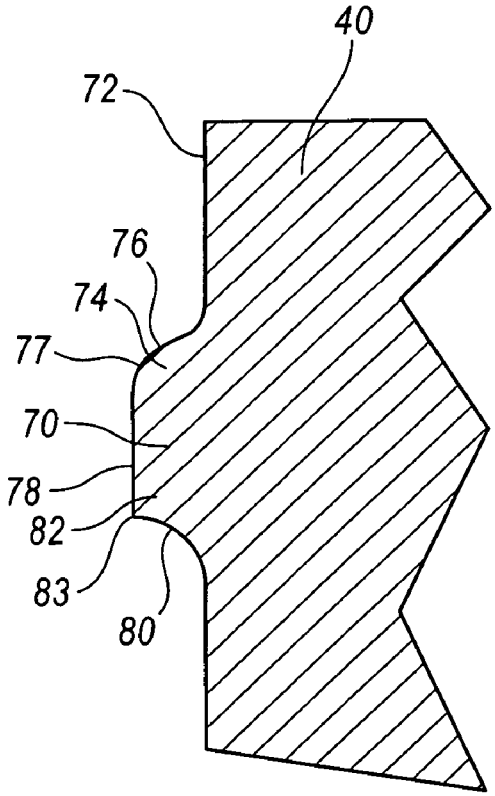
FIG. 3 is an enlarged cross-sectional view of a first embodiment of a valve stem sealing lip area.

Accordingly, FIGS. 2 and 3 show a first embodiment of the valve stem assembly 10. FIG. 3 is an exploded view of seal area A in FIG. 2. In this embodiment, a sealing lip 70 is shown extending outwardly from an inner sealing surface 72 of the sealing member 40. An upper portion 74 of the sealing lip 70 includes a downwardly sloping upper surface 76 with a generally rounded corner 77. The upper surface 76 may be perpendicular in cross-section to the valve stem 22 in addition to having other geometries including a square or an upwardly sloping surface. A sealing surface 78 that contacts the valve stem 22 is positioned above a notch 80. The notch 80, which is positioned at a bottom portion 82 of the sealing lip 70 includes a square or inwardly sloping surface having a generally square-like corner 83. The present design prevents liquid flow in the upward direction, that is it prevents liquid from traveling upwardly from the intake ports of the engine into overhead engine oil.

Figure 4:
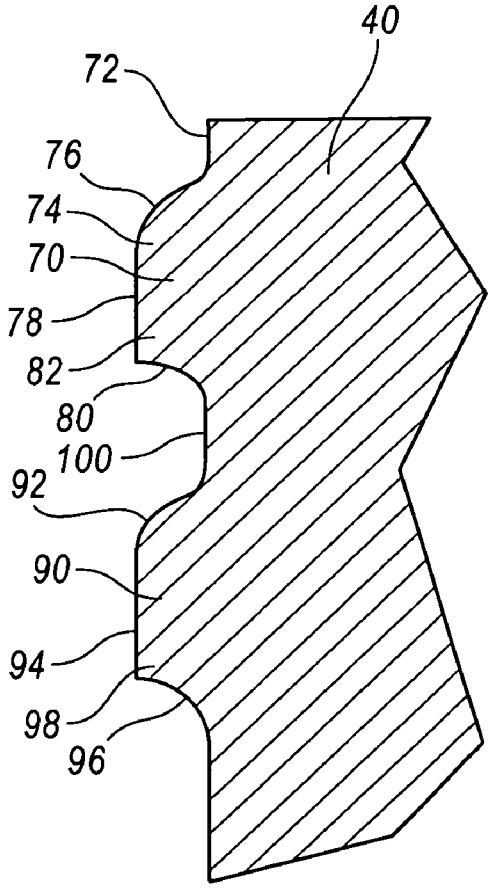
FIG. 4 is an enlarged cross-sectional view of a second embodiment of a valve stem sealing lip area.

FIG. 4 represents a second embodiment of the valve stem assembly 10. In this embodiment, seal area A includes at least two sealing lips, an upper lip 70 and a lower lip 90. Generally similar to the design shown in FIG. 3, both upper and lower lips 70, 90 include downwardly sloping surfaces 76, 92, sealing surfaces 78, 94 and notches 80, 96. However, in one embodiment, the bottom portion 82 of upper sealing lip 70 is angled at less of a degree than the bottom portion 98 of the lower sealing lip 90. A gap 100 is shown disposed between the upper sealing lip 70 and the lower sealing lip 90. The gap 100 functions as a buffer between the two sealing lips and further minimizes liquid from traveling upwardly from the intake ports of the engine into overhead engine oil.

The preceding description has been presented only to illustrate and describe exemplary embodiments of the methods and systems of the present invention. It is not intended to be exhaustive or to limit the invention to any precise form disclosed. It will be understood by those skilled in the art that various changes may be made and equivalents may be substituted for elements thereof without departing from the scope of the invention. In addition, many modifications may be made to adapt a particular situation or material to the teachings of the invention without departing from the essential scope. Therefore, it is intended that the invention not be limited to the particular embodiment disclosed as the best mode contemplated for carrying out this invention, but that the invention will include all embodiments falling within the scope of the claims. The invention may be practiced otherwise than is specifically explained and illustrated without departing from its spirit or scope. The scope of the invention is limited solely by the following claims.

What is claimed is:

1. A valve stem seal comprising:

an annular body having an outer surface and an inner sealing surface, said inner sealing surface including an upper portion and a lower portion, said upper portion having a smaller diameter than said lower portion; and at least one sealing lip disposed on said upper portion of said inner sealing surface and extending away from said inner sealing surface such that the outward face of said least one sealing lip is generally parallel to a valve stem when in an installed position, said at least one sealing lip having a generally square lower corner and a generally rounded upper corner.

2. The valve stem seal of claim 1, wherein said annular body is formed from an elastomeric material.

3. The valve stem seal of claim 1, wherein said annular body includes a gap between a first sealing lip and a second sealing lip of said at least one sealing lip.

4. The valve stem seal of claim 3, wherein a first lower corner of said first sealing lip includes a different angle than a second lower corner of said second sealing lip.

5. The valve stem seal of claim 1, wherein at least a portion of said outer surface is adapted to selectively engage a seal retainer.

6. The valve stem seal of claim 1, further including a notch formed below said sealing surface.

7. The valve stem seal of claim 1, wherein said at least one sealing lip selectively seals a valve stem and said generally square lower corner minimizes ingress of a liquid upwardly from an intake port area into an overhead engine area.

8. In a valve assembly of an internal combustion engine having a valve stem seal, wherein the valve stem seal includes an outer peripheral surface and an inner sealing surface for minimizing ingress of a liquid upwardly from an intake port area into an overhead engine area comprising:

at least one sealing lip disposed on an upper portion of the inner sealing surface and extending away from the inner sealing surface such that the outward face of said least one sealing lip is generally parallel to a valve stem when in an installed position, said at least one sealing lip having a generally square lower corner and a generally rounded upper corner.

9. The valve assembly of claim 8, wherein the valve stem seal includes a gap between a first sealing lip and a second sealing lip of said at least one sealing lip.

10. The valve assembly of claim 9, wherein a first lower corner of said first sealing lip includes a different angle than a second lower corner of said second sealing lip.

11. The valve assembly of claim 8, wherein at least a portion of the outer peripheral surface is adapted to selectively engage a seal retainer.

12. The valve stem seal of claim 8, further including a notch formed below said sealing surface.

13. A method of minimizing ingress of a liquid upwardly from an intake port area into an overhead engine area comprising the steps of:

providing an annular body having an outer surface and an inner sealing surface, said inner sealing surface including an upper portion and a lower portion, said upper portion having a smaller diameter than said lower portion; and placing at least one sealing lip on said upper portion of said inner sealing surface extending away from said inner sealing surface such that the outward face of said least one sealing lip is generally parallel to a valve stem when in an installed position, and, said at least one sealing lip having a generally square lower corner and a generally rounded upper corner.

14. The method of claim 13, further including the step of forming said annular body from an elastomeric material.

15. The method of claim 13, further including the step of placing a first sealing lip and a second sealing lip of said at least one sealing lip apart a predetermined distance to form a gap therebetween.

16. The method of claim 13, further including the step of forming a first lower corner of said first sealing lip at a different angle than a second lower corner of said second sealing lip.

* * * * *